US006427059B1

(12) United States Patent
Buch et al.

(10) Patent No.: US 6,427,059 B1
(45) Date of Patent: Jul. 30, 2002

(54) APPARATUS FOR POSITIONING WORK STATIONS IN A DOCUMENT PRINTER/ COPIER

(75) Inventors: Donald Calvin Buch; Robert Michael Peffer, both of Penfield; Michael Bidmon; Paul Hong Ping Tam, both of Pittsford, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/474,352

(22) Filed: Dec. 29, 1999

(51) Int. Cl.[7] ..... G03G 15/00
(52) U.S. Cl. ..... 399/110; 399/107; 399/117
(58) Field of Search ..... 399/110, 111, 399/113, 116, 117, 121, 159, 167, 107, 302, 308

(56) References Cited

U.S. PATENT DOCUMENTS 3,985,436 A * 10/1976 Tanaka et al. ..... 399/117
4,128,079 A * 12/1978 Suzuki ..... 118/658
5,142,322 A * 8/1992 Surti ..... 399/117
5,758,233 A * 5/1998 Coffey et al. ..... 399/111
5,832,345 A * 11/1998 Damji et al. ..... 399/167

* cited by examiner

*Primary Examiner*—Arthur T. Grimley
*Assistant Examiner*—Hoang Ngo
(74) *Attorney, Agent, or Firm*—Lawrence P. Kessler

(57) ABSTRACT

Apparatus for precisely positioning the various work stations (e.g., image-forming, cleaning and image-transfer stations) of an electrophotographic printer/copier relative to the outer surface of a rotating drum, e.g., an image-forming drum or an image-transfer drum. Such apparatus comprises a pair of drum-support members, each having associated reference surface features adapted to mate with complimentary reference surface features on the individual work stations. Preferably, the placement of the reference surface features of the drum-support members are factory set to account for any idiosyncrasies (e.g., run-out) of a drum supported by such members.

7 Claims, 6 Drawing Sheets

APPARATUS FOR POSITIONING WORK STATIONS IN A DOCUMENT PRINTER/ COPIER

CROSS-REFERENCE TO RELATED APPLICATIONS

Reference is made to the commonly assigned U.S. patent application Ser. No. 09/473,417, filed concurrently herewith and entitled "Protective Container/Installation Fixture for Image Recording/Image Transfer Drums".

FIELD OF THE INVENTION

This invention relates to the field of document printing/copying. More particularly, it relates to improvements in apparatus for precisely and repeatedly positioning the various work stations of a document printer/copier, e.g., an electrophotographic printer/copier, relative to a reusable image-recording drum and/or image transfer drum to enable, for example, removal, servicing and replacement of the individual work stations and/or drum(s) without altering a desired positional relationship between the work stations and drum(s).

BACKGROUND OF THE INVENTION

In electrophotographic printers and copiers, a toner image is formed on the surface of a photoconductive recording element. This image is commonly transferred, either directly or indirectly, to a sheet of paper, thereby enabling the recording element to be re-cycled through the image-forming process to make multiple prints/copies. Often, the physical form of the recording element is that of a drum having an outer surface of photoconductive material, either organic or inorganic. As the drum rotates, various work stations positioned about the drum periphery operate collectively to produce the toner image on the drum's photoconductive surface. These work stations usually comprise (i) a primary charging station for depositing a substantially uniform electrostatic charge on the drum's photoconductive surface; (ii) an exposure station for imagewise exposing the uniform charge to actinic radiation, thereby selectively dissipating the uniform charge to produce a charge image; and (iii) a development station for applying pigmented thermoplastic particles (toner) to the charge image to render it visible. In addition to these image-processing stations, other work stations, also positioned about the drum periphery, serve to transfer the toner image thus formed to an image-receiving member, e.g., a sheet of paper or to an intermediate transfer drum from which it may be subsequently transferred to paper or the like, and to remove residual or non-transferred toner from the drum's photoconductive surface prior to recycling the drum through the image-forming process. When using an imagetransfer drum, an additional toner-cleaning station is positioned adjacent the transfer drum, downstream from the second image-transfer station, to remove residual toner particles.

As will be appreciated, the consistent production of high quality images requires that certain positional relationships be established and maintained at all times between the above work stations and the photoconductive drum and imagetransfer drums. For example, the spacing between the drum surface and the corona discharge wire(s) of the primary charging station and the cleaning stations must be maintained uniform across the drum surface in order to assure a uniform charge distribution across the drum surface. Further, the spacing between the drum surface and a toner-applying magnetic brush or the like must be kept within a very tight tolerance to consistently achieve a desired image density. The same holds true for spacing between the drum surface and the exposure station, which may be in the form of a solid-state print head or an optical projection system, in order to consistently form a sharply focused image on the drum's photosensitive surface. In some printer/copiers, such positioning of the work stations relative to the recording drum is maintained by using wheels that contact and are rotate on the drum's outer surface. In other machines, reference rings or other structures are used to maintain the desired spacing. All such approaches require the use of precision parts, which are problematic from the standpoints of cost, contamination, run-out and wear.

One example of positioning apparatus of the above type is disclosed in U.S. Pat. No. 5,089,846 to H. Tabuchi. In this disclosure, an exposure station in the form of an array of light-emitting diodes is supported for pivotal movement towards and away from a photoconductive drum. Positioning means mounted on the pivotal support has an end that is adapted to contact and ride upon the outer edge of the photoconductive drum and thereby establish a desired spacing between the drum surface and the operative surfaces of the LED array. A second support pivotally mounted on the first support is spring biased to urge the first support towards engagement with the drum surface, and a cam surface mounted on the machine frame interacts with the second member to adjust its pivotal position. While intended to provide a simple and inexpensive approach to achieving high positional accuracy between the drum surface and the operative surface of the LED array, this approach is still subject to many of the aforementioned disadvantages, requiring the use of precision parts that eventually wear-out and introduce contamination.

SUMMARY OF THE INVENTION

In view of the foregoing discussion, an object of this invention is to provide improved apparatus for precisely positioning one or more of the work stations of a document printer/copier relative to an internal drum (e.g., an image-recording and/or an intermediate image-transfer drum), work station-positioning apparatus that is improved from the standpoint that it is not subject to the aforementioned disadvantages of the prior art.

According to a preferred embodiment of the invention, improved apparatus is provided for precisely positioning each of a plurality of work stations of an electrophotographic document printer/copier relative to the outer surface of a rotating drum on which each work station is required to carry out a process. The apparatus of the invention operates to precisely position an operative component of each work station (c.g., a corona wire, development brush, image-transfer drum, etc.) substantially parallel to and spaced a desired distance from the surface of the rotating drum. The apparatus of the invention comprises (a) means defining a plurality of reference surfaces or surface features on each work station, each reference surface being located in a predetermined position relative to the operative component of its associated work station, and (b) a pair of drum-support members, each having a centrally located bearing adapted to receive and rotatably support an end of said drum. Each drum-support member is provided with a plurality of work station-positioning reference surfaces having a shape complimentary to that of a reference surface on a work station it is intended to precisely position. The work station-positioning reference surfaces on the drum support members are pre-determinedly located, preferably by the manufacturer, with respect to the outer surface of a drum rotatably-supported in the respective bearings of the drum-support members. Thus, when a work station is moved to a position in which its respective reference surfaces come into contact with the complimentary reference surfaces of the drum-support members, the work station will be positioned such that its respective operative component will be precisely positioned substantially parallel to the outer surface of a drum rotatably supported by the drum-support members.

By factory adjusting the location of the respective reference surfaces of a pair of drum-support members to account for any idiosyncrasies (e.g., eccentricity, run-out, etc.) of a photosensitive drum supported by such members, there is no need for further adjustment at a customer site when replacing or servicing a drum or work station. Further, there being no movable parts (e.g., wheels or rings) or other precision spacer components that ride on the surface of the moving drum for the purpose of providing a desired spacing between the drum surface and work station(s), the above-noted problems of wear, run-out and contamination are virtually eliminated, as is the cost of replacing these spacing components.

The invention and its technical advantageous effects will be better appreciated from the ensuing detailed description of a preferred embodiment, reference being made to the accompanying drawings in which like reference characters denote like or functionally similar parts.

DETAILED DESCRIPTION OF THE INVENTION

Figure 1A:
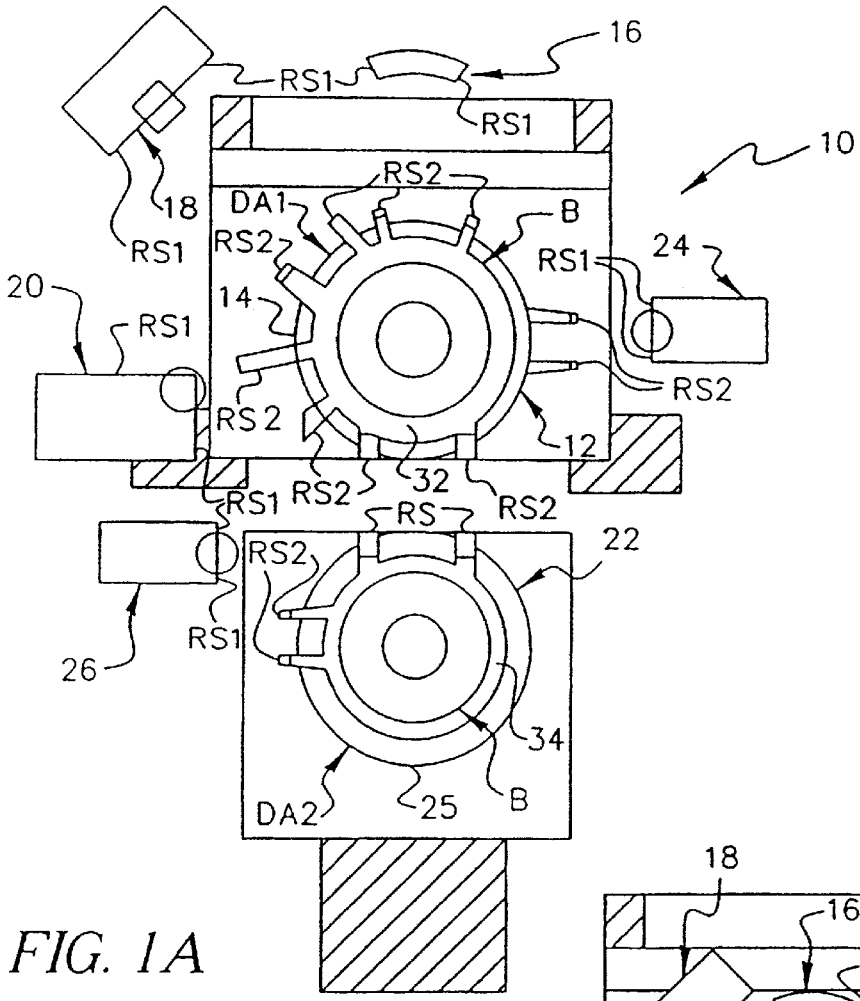
FIGS. 1A and 1B are schematic end views of an electrophotographic printer respectively illustrating the inventive concept for positioning various work stations relative to the respective outer surface of a pair of rotatably driven drums.
Figure 1B:
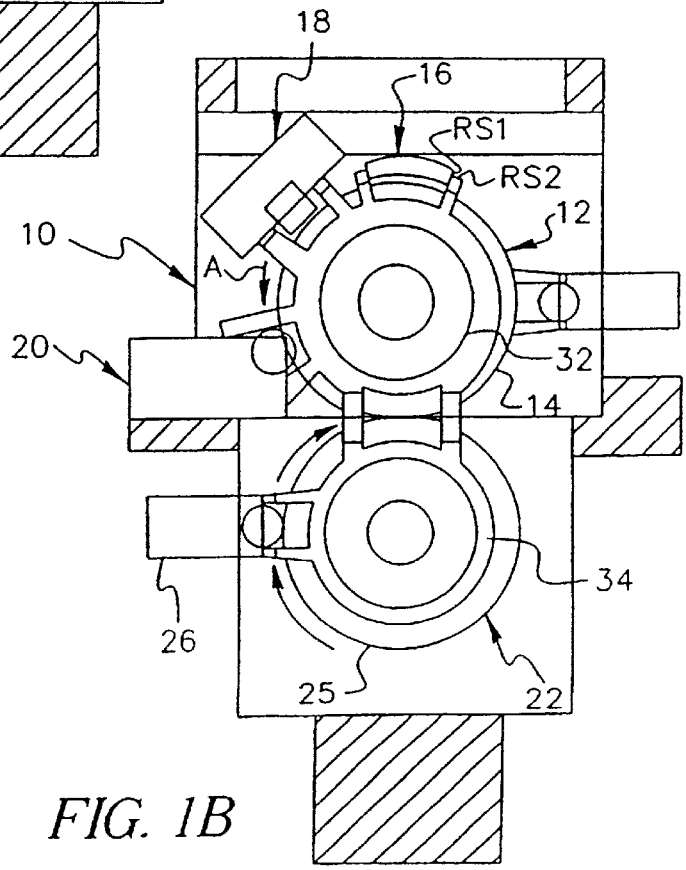

Referring now to the drawings, FIGS. 1A and 1B schematically illustrate an electrophotographic printer 10 embodying the present invention. As shown, printer 10 comprises a pair of drum assemblies, DA1, DA2. Drum assembly DA1 comprises an image-recording drum 12 having a photoconductive outer layer 14 on which toner images are formed in a conventional manner. Drum assembly DA2 comprises an intermediate image-transfer drum 22 having an abhesive (non-stick) surface 25 to which toner images formed on the photoconductive outer surface of image-recording drum 12 are transferred prior to being re-transferred to a receiver sheet (not shown). Briefly, toner images are formed on the photoconductive surface of drum 12 by rotating the drum in the direction of the arrow A (shown in FIG. 1B) past a series of work stations that sequentially operate on a desired portion of the drum's photoconductive outer surface. These work stations include a corona charging station 16 that serves to uniformly electrostatically charge the photoconductive surface, a solid-state print head 18 for imagewise exposing the charged photoconductive surface, line-by-line, to actinic radiation, thereby selectively dissipating the uniform charge and leaving behind a latent electrostatic charge image, and a development station 20 for developing the charge image with electroscopic toner particles. The toner image thus formed is then transferred to the outer surface 25 of the image-transfer drum 22, and residual toner on drum 12 is removed by a cleaning station 24. Upon transferring the toner image on the intermediate transfer drum 22 to an image-receiver sheet, the surface of drum 22 is cleaned by a second cleaning station 26. Preferably, each processing station is mounted for slight movement (e.g., about 5 to 7 mm) towards and away from its respective operative position adjacent the drum surface (shown in FIG. 1B) to provide minimal clearance for installation and replacement of the drum assemblies. During such installation, the drum assemblies are moved substantially parallel to drum's respective axis of rotation, through an opening in the machine frame.

Now in accordance with the present invention, apparatus is provided for precisely and repeatedly positioning the various work stations of a document printer/copier of the type described above relative to the outer surfaces of an image-recording drum and/or an image transfer drum to enable, for example, removal, servicing and replacement of the individual work stations and/or drum(s) without altering a desired positional relationship between the work stations and drum(s). Referring additionally to the schematic illustrations of FIGS. 2A and 2B, such apparatus comprises a pair of drum-support members 32,32' and 34,34', each of such members having a centrally located bearing B or the like for rotatably supporting a drum axle 12A extending outwardly an end of drum 12. The drum-support members, in turn, are supported in a predetermined position within the printer frame F, as described in the aforementioned U.S. patent application Ser. No. 09/473,417, filed concurrently herewith and hereby incorporated in its entirety by reference. Each drum-support member is provided with a plurality of reference surface features RS2 which cooperate with complimentary reference surface features RS1 carried by the respective work stations to precisely position the work stations relative to the outer surface of the drum. (Note, the drum-support members 34,34' of drum assembly DA2 has both types of reference surface features (RS1 and RS2) since DA2 is both a work station (i.e., an image transfer station) that operates on drum 12 to transfer a toner image, and a drum on which processing is effected, i.e., by the cleaning station 26.) Thus, as the work stations are moved from their respective stand-by or loading positions shown in FIG. 1A toward their operative positions, shown in FIG.1B, the reference surface features RS1 of the work stations move into contact with and engage the reference surface features RS2 on the drum-support members to locate each work station in a desired position relative to the drum surface.

Figure 3:
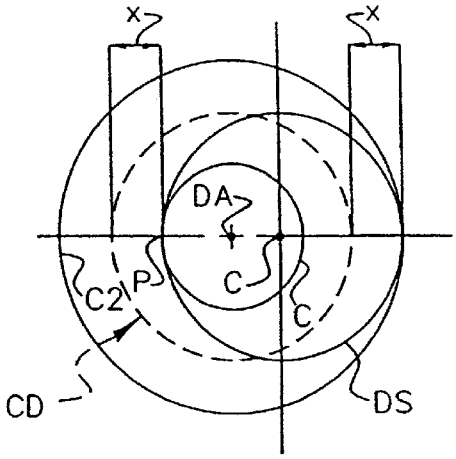
FIG. 3 illustrates a drum "run-out" artifact and a desired calibration setting to compensate for it.

Preferably, as described in detail below, the exact positions of the respective reference surface features RS1 and RS2 are adjustable with respect to their structural supports so as to provide a means for compensating for structural variations in the component (work station or drum assembly) of which they are a part. For example, it is preferred, though not essential, that the respective positions of the reference surface features RS1 carried by the respective housings of the various work stations be adjustable to compensate for any misalignment of the operative component of a given work station (e.g., the corona discharge wire of the charging station 16, or the toner-applying development brush of the development station 20) relative to a nominal position. Similarly, the positions of the reference surface features RS2 of the drum-support members are preferably adjustable to compensate, for example, for drum "run-out", an artifact arising from an unintended displacement of a drum's axis of rotation relative to its geometric central axis. This artifact is illustrated in FIG. 3. As shown in the drawing, a drum rotating about an axis DA displaced from its geometrical axis C causes a point P on the drum surface DS to fall anywhere between the two circles C1 and C2. The "run-out" of a drum is the maximum variation experienced at the drum's outer surface, or a value of 2X. In accordance with one aspect of the invention, the location of the reference surface features RS2 on the drum-support members are set by the drum assembly manufacturer so that a drum has a calibrated diameter CD midway between the diameters of circles C1 and C2.

Figure 2A:
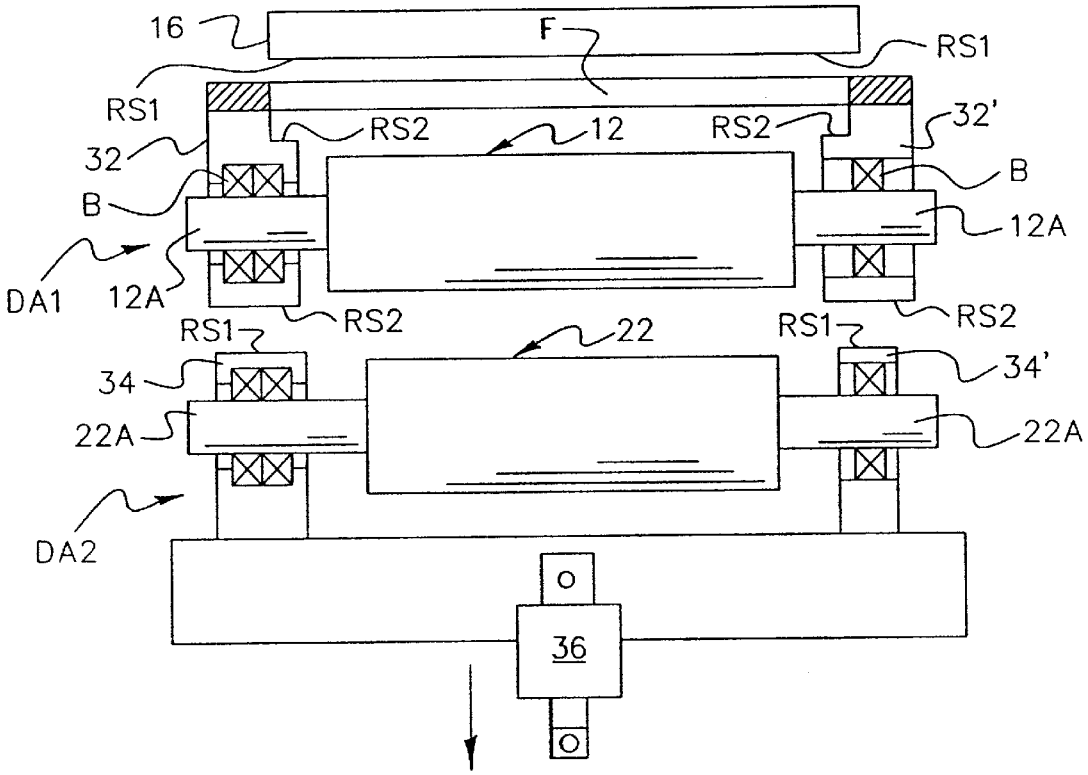
FIGS. 2A and 2B are schematic front views of a portion of an apparatus similar to that shown in FIGS 1A and 1B, respectively.
Figure 2B:
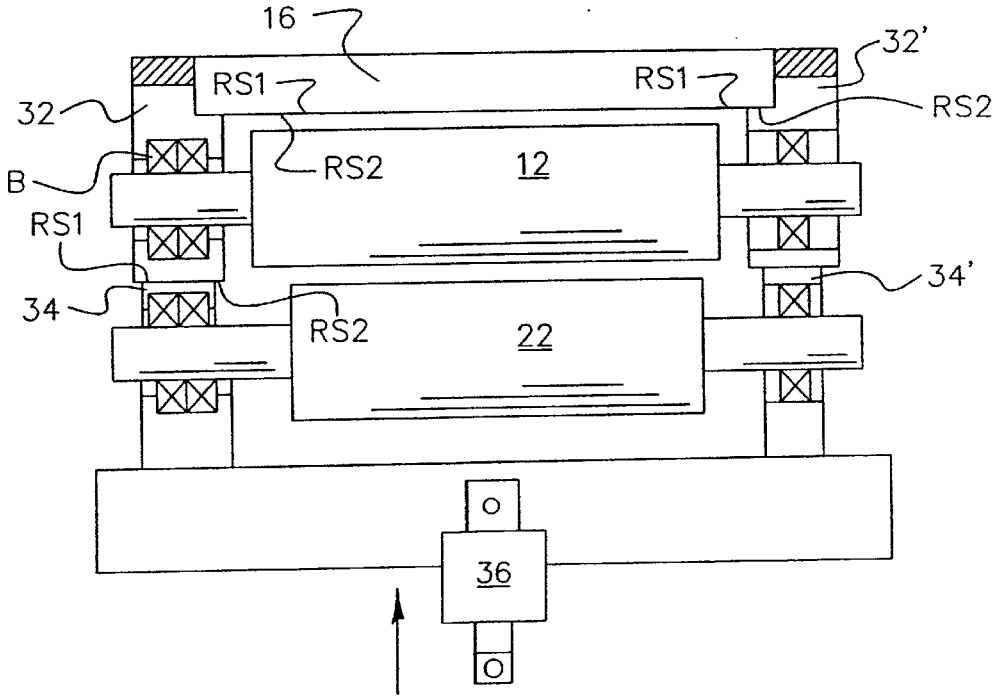

In the schematic illustrations of FIGS. 1A and 1B and FIGS. 2A and 2B, the reference surface features RS1 and RS2 are illustrated as being flat or planar surfaces that are intended to mate flushly together. In FIGS. 2A and 2B, an air cylinder 36 is shown as being used to advance the image transfer drum assembly DA2 towards and away from its operative position in which the reference surfaces RS2 of the drum-support members 34,34' contact the complimentary reference surfaces RS2 carried by drum-support members 32,32'. The corona charging station is movable (by means not shown) from its stand-by position, shown in FIG. 2A, to an operative position, shown in FIG. 2B, in which the reference surfaces RS1 of the corona charger housing rests squarely and flatly upon the complimentary reference surfaces RS2 of the drum-support members 32,32'.

Figure 4A:
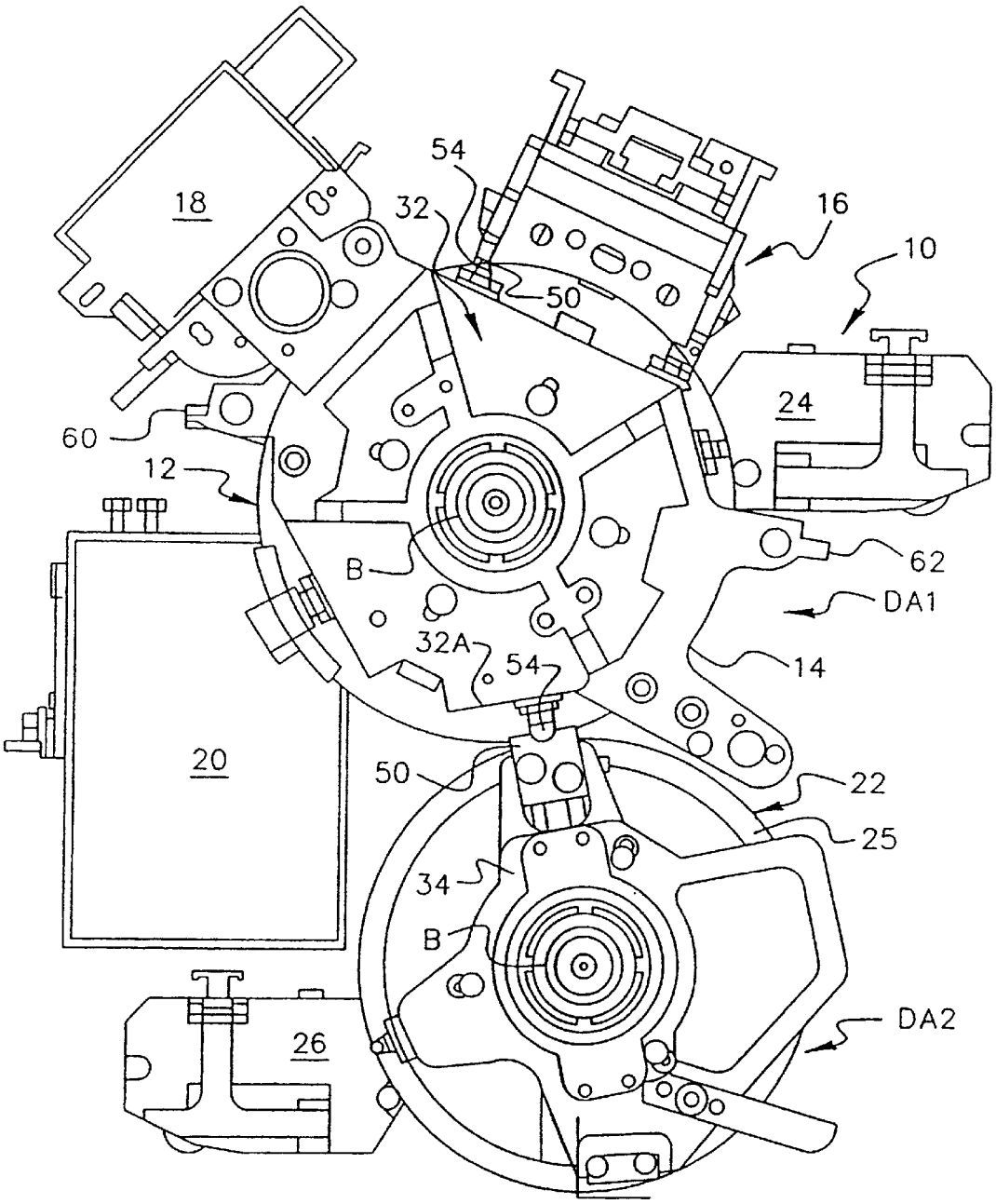
FIG. 4A is an end view of an electrophotographic printer embodying preferred drum-support members comprising the apparatus of the invention.
Figure 4B:
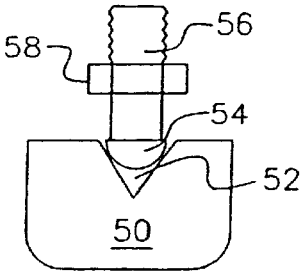
FIG. 4B is an enlarged view of a detail of the apparatus shown in FIG. 4A.

In FIG. 4A, the structural details of preferred drum-support members 32 and 34 are shown as used to position the various work stations of an electrophoto-graphic printer 10. In the preferred versions of the drum-support members, the reference surface features RS1 of most of the work stations take the form of a blocks 50 (shown in FIG. 4B) having a V-groove 52 for receiving a bullet-shaped locator 54 that disposed at the distal end of a threaded member 56. Member 56 is threaded into a threaded hole bored in an outer surface of the drum-support members 32,32', and the height of the locator 54 above its supporting surface (e.g., surface 32A) is adjustable by rotating and setting a nut 58 threaded on member 56.

Figure 5A:
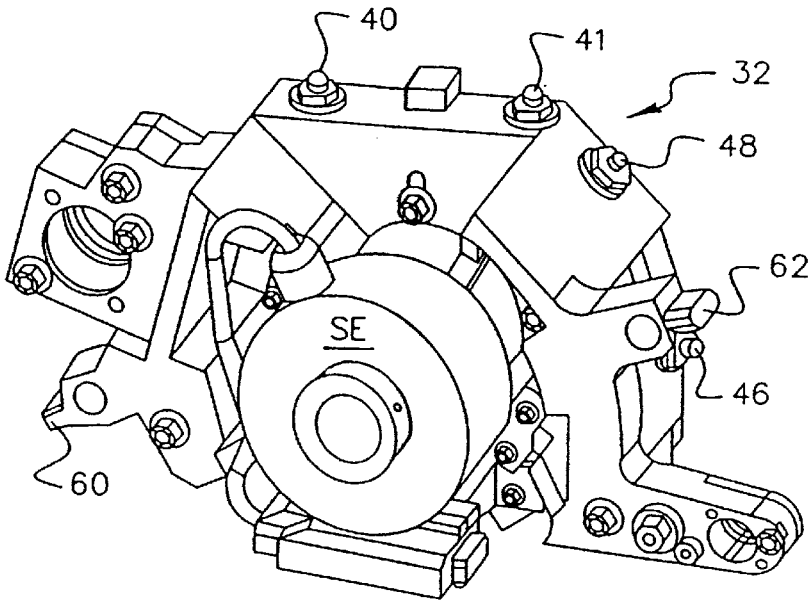
FIGS. 5A and 5B are front isometric views of a preferred drum-support members for supporting a photoconductive drum of the type used in the electrophotographic printer of FIG. 4A.
Figure 5B:
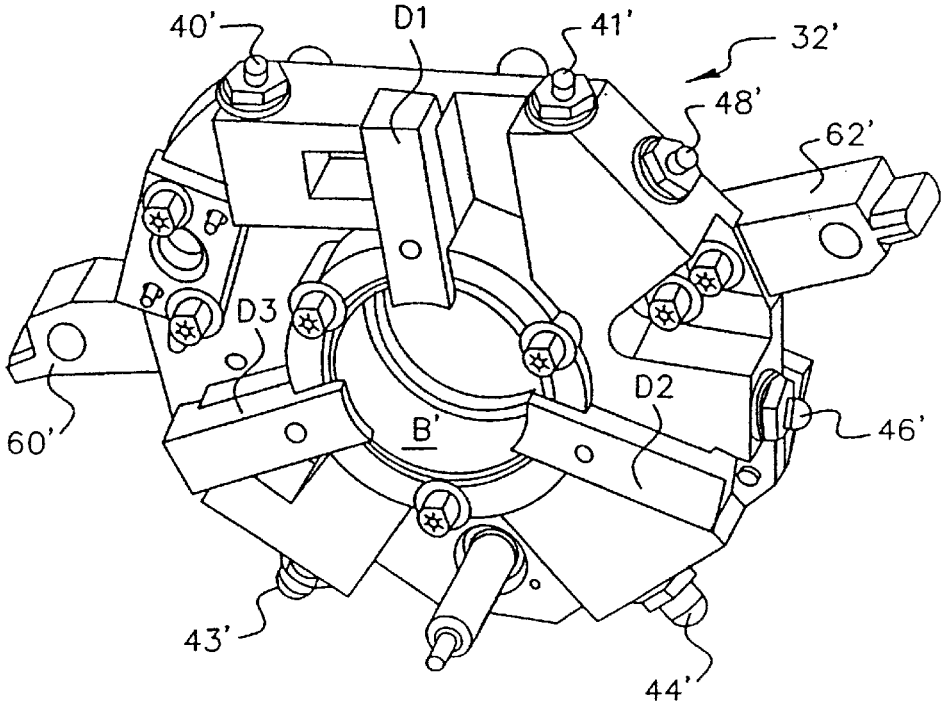
Figure 6A:
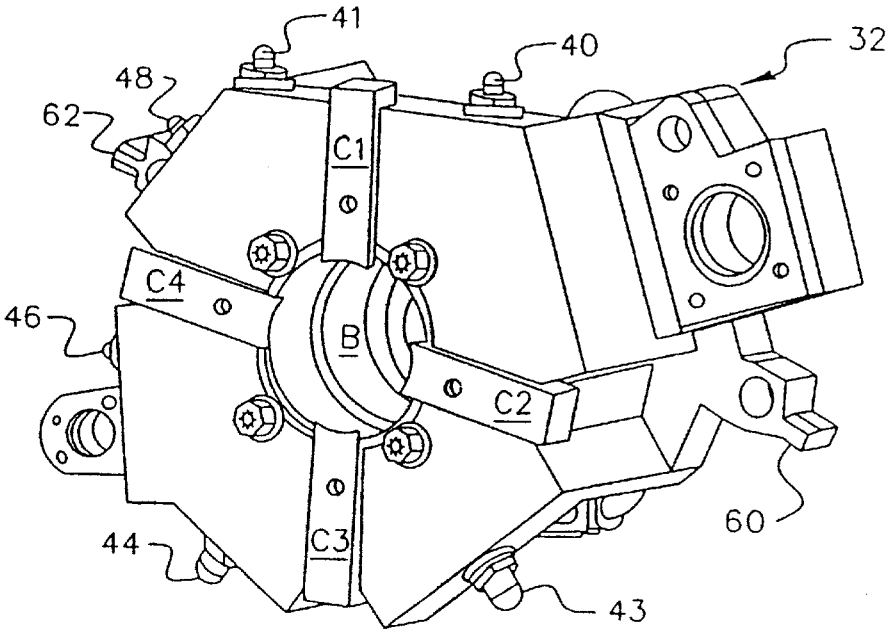
FIGS. 6A and 6B are rear isometric views of the drum-support members shown in FIGS. 5A and 5B, respectively.
Figure 6B:
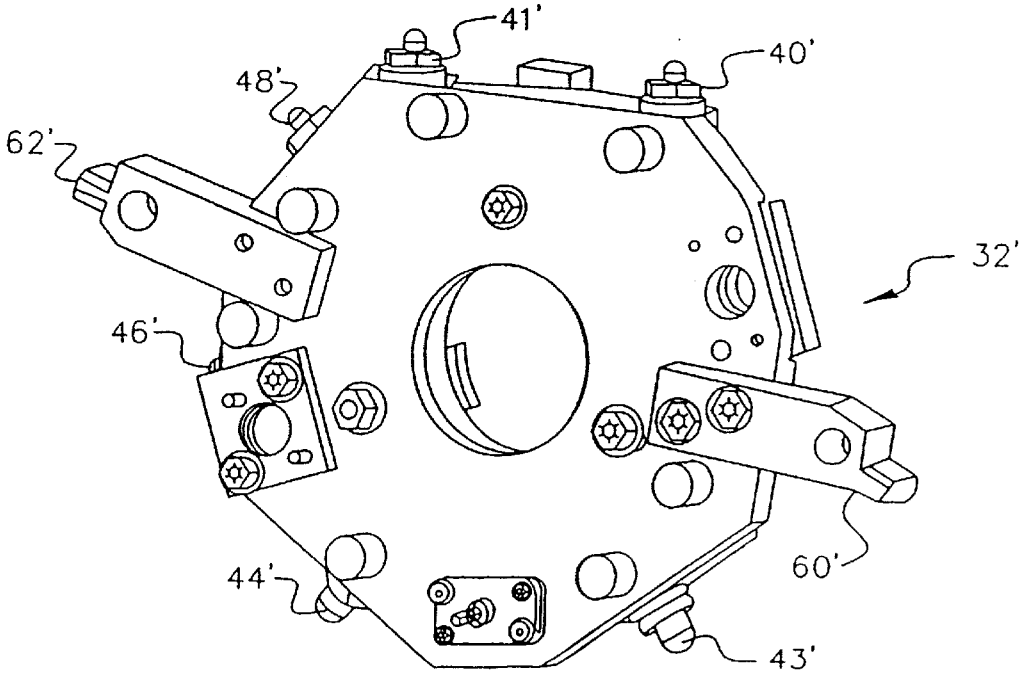

FIGS. 5A and 5B are isometric front views of drum-support members 32 and 32', respectively, and FIGS. 6A and 6B are isometric rear views of the same drum-support members, respectively. Member 32 supports a shaft encoder SE through which the rotational speed of drum 12 is controlled. Member 32 further supports bullet-shaped reference features 40 and 41 which together with features 40' and 41' on drum-support member 32', serve to precisely position the operative component of the corona charging station 16, i.e., the corona discharge wire, substantially parallel to the surface of drum 12. Similarly, features 43 and 43' (shown in FIGS. 6A and 5B) serve to precisely position the operative component of the development station 20; features 44 and 44' serve to position the intermediate transfer drum 22; features 46 and 46' serve to position an optional pre-clean corona charger (forming part of cleaning station for drum 12); and features 48 and 48' serve to position the cleaning brush 24. Preferably, each of the drum-support members 32,32' further comprises a pair of drum-support legs 60,62; 60',62' which, as explained in the aforementioned U.S. patent application Ser. No. Ser. 09/473,417, are slidably received in a pair of spaced parallel channels located within the printer frame for supporting the drum assembly in a desired position within the printer. Four clamps C1-C4 serve to retain the bearing B used to rotatably support one of the drum axles A in member 32, and three additional D1-D3 serve to retain the bearing B' used to rotatably support the other drum axle in member 32'.

Figure 7:
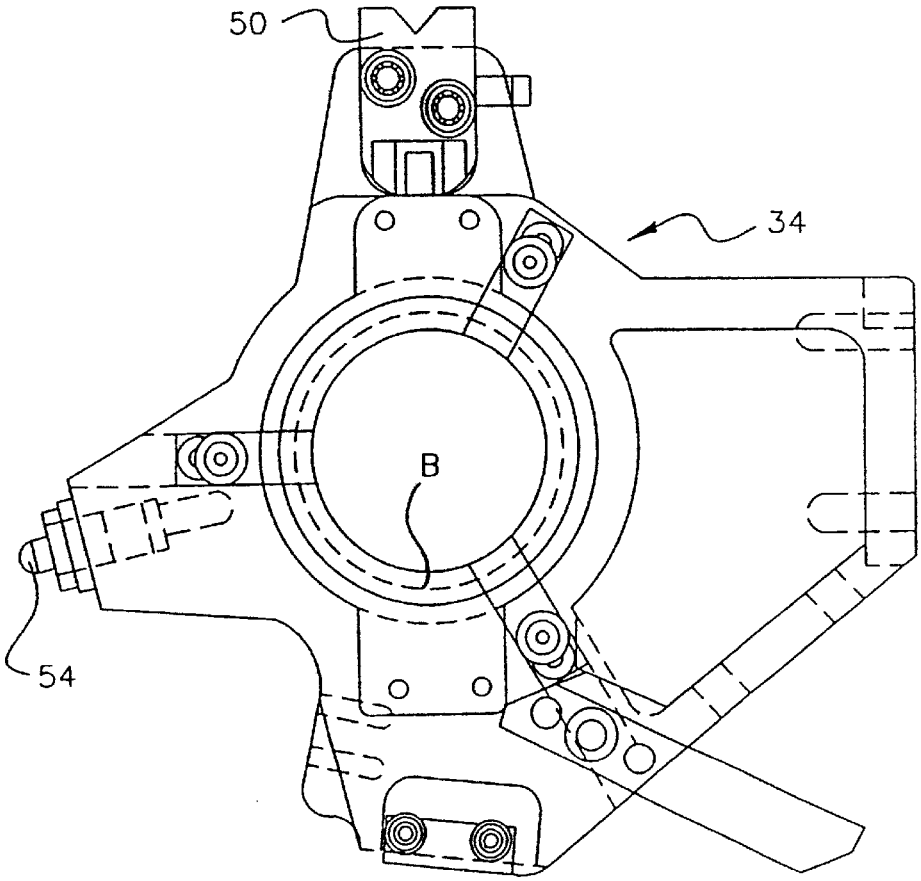
FIG. 7 is a front elevation of a preferred drum-support member for supporting an intermediate image-transfer drum of the type used in the electrophotographic printer of FIG. 4A.

FIG. 7 is a drawing of a preferred member for supporting the intermediate transfer drum 22 in the printer shown in FIG. 4A. As shown, member 34 supports reference surface features of both of the aforedescribed types, namely, an adjustable bullet-type reference feature 54 which is intended to be received in a V-grooved block carried by the frame of cleaning station 26, and a V-grooved block 50 which is intended to be engaged by a bullet-shaped feature (feature 44 in FIG. 6A) of the drum-support member 32.

While the invention has been described with reference to a particularly preferred embodiment, it will be appreciated that variations can be made without departing from the spirit of the invention, and such variations are intended to fall within the scope of the appended claims.

PARTS LIST

10—electrophotographic printer
12—image-recording drum
14—photoconductive surface
16—corona charging station
18—print head
20—development station
22—image-transfer drum
24—cleaning station
26—cleaning station
DA1—drum assembly 1
DA2—drum assembly 2
A—drum axles
B—bearings
32,32'—drum support members for drum 12
34,34'—drum support members for drum 22
40,41,40',41'—reference features on drum support members 32,32' for positioning charging station 14
43, 43'—reference features on drum supports 32,32' for positioning the development station 20
44,44'—reference features on drum support members 32,32' for positioning image-transfer drum 22
46,46'—reference features on drum support members 32,32' for positioning preclean corona charger 23
48,48'—reference feature on drum support members 32.32' for positioning cleaning brush 24
50—V-grooved block
52—groove
54—bullet-shaped reference feature
56—threaded member
58—nut
60,62—drum-support legs
SE—shaft encoder
C1–C4—bearing-retainers
D1–D3—bearing retainers

What is claimed is:

1. Apparatus for precisely positioning a plurality of work stations relative to the outer surface of a rotating drum on which each of such work stations is required to carry out a process, each of said work stations comprising a housing containing an elongated operative component extending along a longitudinal axis and adapted to effect a process to be carried out by its respective work station upon the external surface of said drum, said apparatus comprising:

(a) means defining one or more reference surfaces on the respective housings of said work stations, said reference surfaces being located in predetermined positions with respect to the operative component of its work stations; and (b) a pair of drum-support members, each having a centrally located bearing adapted to receive and rotatably support one end of said drum at a predetermined position relative to a longitudinal axis of said bearing, each drum-support member having a plurality of sets of work station-positioning reference surfaces thereon, each of said sets being positioned to be engaged by said reference surfaces associated with one of said work stations to position the operative component of said work station in a predetermined position relative to the surface of said drum.

2. The apparatus as defined by claim 1 wherein said sets of work station-positioning reference surfaces are located to position the operative component of said work station in a position substantially parallel to the drum's outer surface.

3. The apparatus defined by claim 1 wherein: (a) said drum has a photoconductive outer surface; (b) said plurality of work stations comprises means for forming a transferable toner image on said photoconductive surface; and (c) one of said work stations comprises an intermediate image-transfer drum having an outer surface to which said toner image formed on said photoconductive surface is transferable, said intermediate image-transfer drum being rotatably supported by a second pair of drum support members, each drum support member of said second pair having associated reference surface adapted to mate with a reference surface associated with first pair of drum support members, whereby an image-transfer nip is formed between said drums.

4. The apparatus defined by claim 1 wherein the respective locations of at least some of said reference surfaces associated with said drum-support members are adjustable relative to the outer surface of said drums.

5. Apparatus for precisely positioning a plurality of work stations relative to the external surface of a rotating drum on which each of such work stations is required to carry out a process, each of said work stations extending along a longitudinal axis and having one or more reference surfaces located in predetermined positions with respect to an operative component that effects a process carried out by its respective work station, said apparatus comprising:

a pair of drum-support members, each having a centrally located bearing adapted to receive and rotatably support one end of said drum at a predetermined position relative to a longitudinal axis of said bearing, each drum-support member having a plurality of work station-positioning reference surfaces located in predetermined positions relative to the outer surface of a drum supported by the respective bearing of such drum-support member, said reference surfaces of said drum-support members being adapted to mate with the reference surfaces associated with said work stations to position said work stations parallel to the outer surface of the drum and to precisely space an operative component of each work station at a desired predetermined distance from the drum's surface.

6. A drum assembly adapted for use in an electrophotographic printer/copier, said drum assembly comprising:

(a) a drum having a photoconductive outer layer upon which a plurality of work stations are intended to operate to produce an image; and (b) a pair of drum-support members for rotatably supporting said drum for rotation about a longitudinal drum axis, each of said drum-support members having a centrally located bearing adapted to receive and rotatably support one end of said drum at a predetermined position relative to a longitudinal axis of said bearing, each drum-support member having a plurality of work station-positioning reference surfaces located in predetermined positions relative to the outer surface of a drum supported by the respective bearing of such drum-support member, said reference surfaces of said drum-support members being adapted to mate with the reference surfaces associated with said work stations to position operative components of said work stations substantially parallel to the outer surface of the drum and to precisely space said operative component of each work station at a desired predetermined distance from the drum's surface.

7. The drum assembly as defined by claim 6 further comprising means for adjusting the respective positions of said work station-positioning reference surfaces relative to a surface on said drum-support members.

* * * * *